US010096976B2

(12) United States Patent
Benz et al.

(10) Patent No.: US 10,096,976 B2
(45) Date of Patent: Oct. 9, 2018

(54) SPARK PLUG WITH ELECTRODE WITH A DEEP WELDING SEAM, SPARK PLUG WITH THE SPARK PLUG ELECTRODE, AND PRODUCTION METHOD FOR THE SPARK PLUG ELECTRODE

(71) Applicant: Robert Bosch GmbH, Stuttgart (DE)

(72) Inventors: Andreas Benz, Bamberg (DE); Sabine Blankl, Bischberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 5 days.

(21) Appl. No.: 15/534,086

(22) PCT Filed: Oct. 9, 2015

(86) PCT No.: PCT/EP2015/073350

§ 371 (c)(1),
(2) Date: Jun. 8, 2017

(87) PCT Pub. No.: WO2016/091430

PCT Pub. Date: Jun. 16, 2016

(65) Prior Publication Data

US 2017/0338631 A1 Nov. 23, 2017

(30) Foreign Application Priority Data

Dec. 10, 2014 (DE) ..... 10 2014 225 402

(51) Int. Cl.
*H01T 13/20* (2006.01)
*H01T 13/32* (2006.01)
(Continued)

(52) U.S. Cl.
CPC ..... *H01T 21/02* (2013.01); *H01T 13/10* (2013.01); *H01T 13/20* (2013.01); *H01T 13/32* (2013.01)

(58) Field of Classification Search
CPC ..... H01T 13/20; H01T 13/32; H01T 13/39
See application file for complete search history.

(56) References Cited

U.S. PATENT DOCUMENTS 8,994,257 B2 * 3/2015 Ishiguro ..... H01T 13/39 313/144
2002/0105254 A1 * 8/2002 Hori ..... H01T 13/39 313/141
(Continued)

FOREIGN PATENT DOCUMENTS

DE 60000298 T2 12/2002
DE 102006036440 A1 2/2008
(Continued)

OTHER PUBLICATIONS

International Search Report dated Jan. 19, 2016, of the corresponding International Application PCT/EP2015/073350 filed Oct. 9, 2015.

*Primary Examiner* — Mariceli Santiago
(74) *Attorney, Agent, or Firm* — Norton Rose Fulbright US LLP; Gerard Messina

(57) ABSTRACT

An electrode for a spark plug, having an electrode base body and a cylindrical wear part, the wear part having a longitudinal axis that extends from an end face of the wear part, facing the electrode base body, to an end face situated opposite this end face, and the wear part having a first region and a second region, the wear part not being fused in the first region and the wear part being fused in the second region.

5 Claims, 4 Drawing Sheets

(51) Int. Cl.
*H01T 21/02* (2006.01)
*H01T 13/10* (2006.01)

(56) References Cited

U.S. PATENT DOCUMENTS

| | | | | |
|---|---|---|---|---|
| 2004/0189169 | A1* | 9/2004 | Taniguchi | H01T 13/39 313/141 |
| 2010/0258541 | A1* | 10/2010 | Ohm | H01T 21/02 219/121.64 |
| 2012/0062099 | A1 | 3/2012 | Miyashita et al. | |
| 2013/0200773 | A1* | 8/2013 | Sakayanagi | H01T 13/32 313/141 |
| 2013/0214670 | A1* | 8/2013 | Suzuki | H01T 13/32 313/141 |
| 2013/0221832 | A1 | 8/2013 | Ishiguro et al. | |
| 2014/0139098 | A1* | 5/2014 | Katsuraya | H01T 13/39 313/141 |

FOREIGN PATENT DOCUMENTS

| | | | |
|---|---|---|---|
| DE | 102013105698 | A1 | 12/2013 |
| EP | 2393172 | A1 | 12/2011 |
| EP | 2696453 | A1 | 2/2014 |
| FR | 2858477 | A1 | 2/2005 |
| JP | 2002050448 | A | 2/2002 |
| JP | 2002170648 | A | 6/2002 |
| JP | 2002231417 | A | 8/2002 |
| JP | 2002237370 | A | 8/2002 |
| JP | 2014157765 | A | 8/2014 |

* cited by examiner

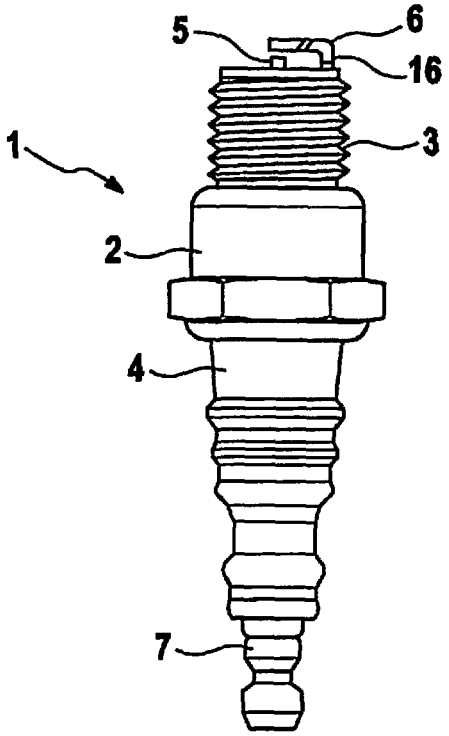
FIG. 1
FIG. 2
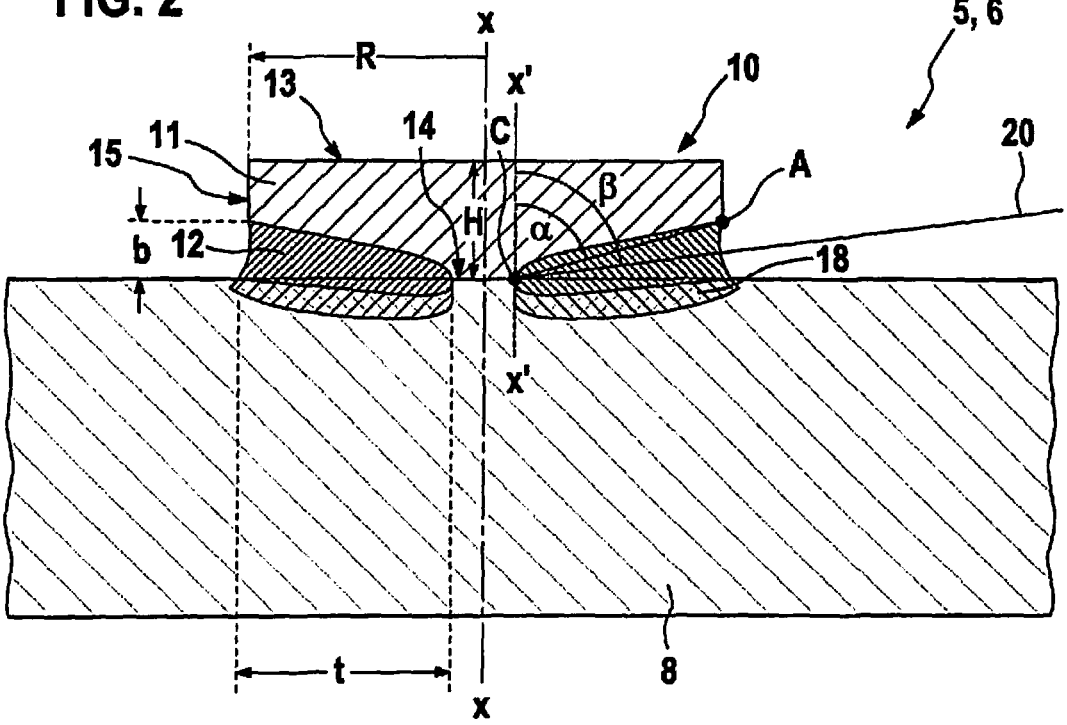

SPARK PLUG WITH ELECTRODE WITH A DEEP WELDING SEAM, SPARK PLUG WITH THE SPARK PLUG ELECTRODE, AND PRODUCTION METHOD FOR THE SPARK PLUG ELECTRODE

FIELD

The present invention relates to an electrode for a spark plug. In addition, the present invention includes a spark plug having at least one spark plug electrode, as well as a method for producing the spark plug electrode.

BACKGROUND INFORMATION

Today's spark plugs have a center electrode and at least one ground electrode. During normal operation of the spark plug, an ignition spark that ignites a combustible gas mixture forms between the electrodes. Typically, the center electrode or ground electrode are made up of an electrode base body and a wear surface situated thereon that contains noble metal. Generally, the wear surface has a higher resistance to oxidation and corrosion, and thus has a lower degree of wear, than does the material of the electrode base body. The wear surface is connected with a material bond to the respective electrode base body by welding. There are various welding techniques, such as resistance welding, laser welding, or electron beam welding, that are used in the production of spark plugs.

Due to the different material properties of the wear part and the electrode base body, in particular the significantly higher melting temperature of the wear part material, the production of a reliable and long-lasting material bond of the two components poses a challenge.

In addition, there is the fact that on the one hand the desired resistance to wear of the wear parts, containing noble metal, is reduced in fused regions of the wear part. In order nonetheless to achieve the desired durability for the electrode and thus also for the spark plug, a certain minimum volume of the unmodified material containing noble metal is required. On the other hand, the noble metal required for a wear part is relatively expensive, so that in principle it is desirable to keep the volume containing noble metal small.

For electrodes having wear parts that have a smaller radius compared to their height, there are bonding methods that provide an acceptable compromise between long life of the welded bond, of the wear part, and of the spark plug, as well as production costs.

SUMMARY

For electrodes in which the radius of the wear part approaches the height of the wear part, or in which the radius becomes greater than the height, the conventional bonding methods provide results that become poorer as the radius increases. Either adequate strength of the material bond is not achieved, or a too-large volume of the wear part containing noble metal must be fused in order to achieve adequate strength of the material bond.

Accordingly, an object of the present invention is to improve an electrode of the type named above, and its production method, in such a way that the disadvantages named above are remedied or minimized.

In accordance with the present invention, for a reliable and long-lasting material bond of the wear part with the electrode base body, a minimum volume of the wear part is fused so that sufficient material is available for alloying with the electrode base body material.

According to the present invention, it is provided that in the wear part a distance AC has an angle $\alpha$ to the longitudinal axis x-x of the wear part, and $\alpha$ is greater than or equal to 45°, the points A and C marking, in a sectional plane along longitudinal axis x-x, transitions in the wear part between at least one first region that is not fused and at least one second region that is fused. The point A marks a first transition on the jacket surface of the cylindrical wear part. The point C marks a further transition that is situated closest to longitudinal axis x-x.

In this way, it results that the extension of the second region in a direction radial to the longitudinal axis is at least equal in length to, or is longer than, its extension in a direction parallel to the longitudinal axis. In this way it is ensured that the material volume required for a stable material bond is fused not only at the edge of the wear part, but also in the interior of the wear part. The electrode has a deep and simultaneously narrow weld seam, a so-called deep weld seam, between the wear part and the electrode base body. In particular, a deep and narrow weld seam is achieved between the electrode base body and the wear part when the distance AC preferably has an angle $\alpha$ greater than or equal to 60° to the longitudinal axis x-x; in particular, $\alpha$ is preferably greater than or equal to 70°, or is even greater than or equal to 80°.

Longitudinal axis x-x of the wear part extends from a side of the wear part oriented toward the electrode base body up to the end face, situated opposite this side, of the wear part. Longitudinal axis x-x stands perpendicular on the end face of the wear part. If the wear part has a cylindrical shape, then longitudinal axis x-x corresponds to the cylinder axis of the wear part. The end faces or end surfaces of the wear part can be round, elliptical, or polygonal. In the case of a polygonal end face, the number of corners is for example less than 12; preferably, the number of corners is three, four, five, or six.

Preferred developments of the present invention are described herein.

The height H of the wear part is measured along longitudinal axis x-x within the first region of the wear part. Radius R of the wear part corresponds to the radius of the perimeter of the end face of the wear part. If longitudinal axis x-x of the wear part goes through the midpoint of the perimeter of the wear part, then radius R of the wear part corresponds to a maximum distance of the jacket surface of the wear part from longitudinal axis x-x. If the end face of the wear part is round, radius R of the wear part is the radius of the circle. Advantageously, radius R of the wear part is greater than or equal to height H of the wear part. In developments of the present invention, it can be provided that radius R of the wear part is greater than or equal to 1.5 times the height H of the wear part, or is greater than or equal to twice the height H of the wear part.

Preferably, it is provided that the distance from point A to the end face of the wear part is not greater than 90% of the height H of the wear part. This ensures that an adequate volume of the wear part has been fused for a stable material bond. In addition or alternatively, it can be provided that the distance from point A to the end face of the wear part is not smaller than 50% of the height H of the wear part, so that the non-fused volume of the wear part is large enough to provide adequate resistance to wear of the wear part.

In an advantageous specific embodiment, it is provided that a shortest distance from the jacket surface of the wear part up to point C is not smaller than 50% of the radius R of the wear part and/or is not larger than 100% of the radius of the wear part. In this way it is ensured that a large enough volume has been fused inside the wear part to provide a stable material bond, and that the bond seam has adequate depth perpendicular to longitudinal axis x-x.

In an advantageous specific embodiment, it is provided that radius R of the wear part is not smaller than 0.75 mm and/or is not larger than 2 mm; preferably, radius R of the wear part is in the range of from 1 mm to 1.5 mm.

Advantageously, it is provided that the height H of the wear part is not smaller than 0.4 mm and/or is not larger than 1 mm; preferably, height H of the wear part is in the range of from 0.5 mm to 0.8 mm.

In addition, the present invention relates to a spark plug that has at least one electrode according to the present invention. The at least one electrode can be fashioned as a center electrode and/or ground electrode. The ground electrode can have the form of a front electrode, side electrode, and/or bow electrode. If the spark plug has a plurality of ground electrodes, then the ground electrodes can have the same shape or can have different shapes.

The present invention also relates to a method for producing an electrode in which a wear part is situated on an electrode base body. By welding, the wear part is materially bonded to the electrode base body, the wear part preferably being cylindrical in shape. With one of its end faces, the wear part stands in direct contact with the electrode base body. A weld beam is preferably radiated into the region of contact of the wear part and electrode base body at an angle β relative to longitudinal axis x-x of the wear part. Through the weld beam, the heat energy required to produce at least one fused region in the wear part is introduced into the wear body. In addition, the energy deposited in the electrode base body by the weld beam also produces at least one fused region in the electrode base body. The fused regions in the wear part and in the electrode base body adjoin one another at least in some regions. In the boundary region of the fused regions in the electrode base body and in the wear part, an alloy region forms at least in some regions, in which the materials of the wear part and of the electrode base body alloy with one another, so that a material bond arises between the wear part and the electrode base body.

According to the present invention, it is provided that the angle β is not smaller than 75°, preferably not smaller than 81°. This achieves the technical effect that the second fused region in the wear part extends away from the jacket surface in the direction of longitudinal axis x-x, and overall there results a deep and at the same time relatively slender bond seam, a so-called deep weld seam. In the sense of the present application, relatively slender means that the maximum extension of the second region in the wear part in a direction radial to longitudinal axis x-x is greater than the maximum extension in a direction parallel to longitudinal axis x-x.

In addition, it may be advantageous for the achieving of this technical effect if the weld beam has a focus diameter of not greater than 50 μm.

Advantageously, the focus point for the weld beam is placed within the contact region of the wear part and the electrode base body. For example, the focus point has a distance from the jacket surface of the wear part in the direction of longitudinal axis x-x of at least 50% of the wear part radius.

Preferably, the wear part is welded at least along a part of the circumference. For example, it can be provided that a continuous weld seam is produced along the entire circumference of the wear part. Alternatively, the weld seam can be divided into a plurality of subsegments, the subsegments being situated at a distance from one another on the jacket surface of the wear part and/or overlapping within the contact region and/or within the wear part and/or within the electrode base body.

Preferably, the non-fused regions in the wear part are contiguous, so that preferably there is only one first region in the wear part.

A laser or an electrode beam can be used as the source for the weld beam. The laser can be operated in pulsed or continuous (CW: continuous-wave) fashion. For example, solid-state lasers, fiber lasers, disk lasers, and/or diode lasers can be used in the weld process.

Preferably, the source of the weld beam, and thus also the weld beam itself, can rotate about the electrode base body and the wear part during the welding. Alternatively, it is also conceivable for the source of the weld beam to be stationary and for the electrode having the electrode base body and the wear part to rotate about an axis, in particular about longitudinal axis x-x of the wear part.

Advantageously, it can be provided that the power of the weld beam is varied during the welding. In this way, power losses due for example to shadowing effects can be compensated and in this way a bond seam that is as uniform as possible can be produced.

For example, it can be provided that in a first operating phase of the weld method the power of the weld beam is constant. In a second operating phase following the first operating phase, the power is continuously reduced or is reduced to a low level that is held constant during the second operating phase.

Alternatively or in addition, it can also be provided that the second operating phase is interrupted by a third operating phase. The third operating phase is preferably temporally shorter than the individual temporal segments of the second operating phase. In the third operating phase, the power of the weld beam is briefly again increased. After the end of the third operating phase, for example the power of the weld beam is again set to its last value in the second operating phase before the interruption by the third operating phase.

Shadowing effects on the power of the weld beam occur when, during the welding, during the rotation of the electrode or of the weld source for example a leg of a ground electrode moves into the weld beam and thus blocks a part of the weld beam.

BRIEF DESCRIPTION OF THE DRAWINGS

FIG. 1 shows an example of a spark plug.

FIG. 2 shows an example of an electrode according to the present invention.

DETAILED DESCRIPTION OF EXAMPLE EMBODIMENTS

Figure 3:
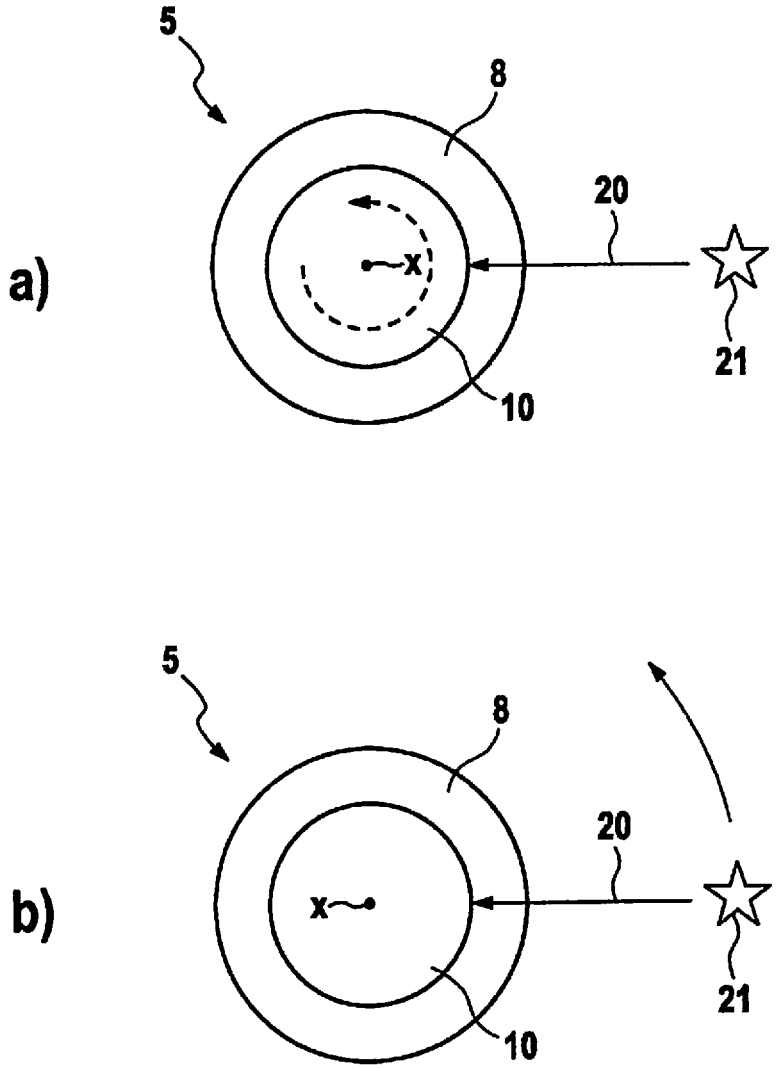
FIG. 3 shows an example of the production of a center electrode according to the present invention.

FIG. 1 shows a schematic representation of a spark plug 1. Spark plug 1 has a metallic housing 2 having a threading 3 for mounting spark plug 1 in an engine block. An insulator 4 is situated inside housing 2. A center electrode 5 and a connecting bolt 7 are situated inside insulator 4, and are electrically connected via a resistance element (not shown). Center electrode 5 typically protrudes from insulator 4 at the end of spark plug 1 at the side of the combustion chamber.

At the combustion-chamber end of housing 2, there is situated a ground electrode 6. This electrode forms an ignition gap with center electrode 5. Ground electrode 6 can be fashioned as a front electrode, a side electrode, or a bow electrode. The bow electrode has two limbs, each welded to housing 2 with their respective leg 16. The limbs have an angle of from 30° to 180° to one another. The bow electrode can be made in one piece or in a multi-part construction, and in the case of a multi-part construction the individual parts are connected to one another by a material bond, such as welding.

FIG. 2 shows a section of an electrode 5, 6 according to the present invention. Electrode 5, 6 has an electrode base body 8 and a wear part 10, wear part 10 being situated on electrode base body 8 in such a way that it forms the ignition gap together with oppositely situated electrode 6, 5, or with a second wear part situated on oppositely situated electrode 6, 5.

Electrode base body 8 is made of a nickel alloy that is alloyed to a low degree or to a high degree. For example, the nickel alloy is alloyed to a low degree with yttrium or is alloyed to a high degree with chromium. The chromium portion in the nickel alloy is for example at least 20 wt %, and is preferably even at least 25 wt %.

Wear part 10 is cylindrical, having round, elliptical, or polygonal end faces, and has a cylinder axis, or longitudinal axis, x-x. Longitudinal axis x-x extends from end surface 13 of the wear part up to oppositely situated side 14, facing electrode base body 8, of the wear part. Height H of wear part 10 is measured along longitudinal axis x-x. Radius R of wear part 10 corresponds to the maximum distance of jacket surface 15 of wear part 10 from longitudinal axis x-x, the distance being measured perpendicular to longitudinal axis x-x, for example at an end surface 13 of the wear part. In this exemplary embodiment, wear part 10 has a round shape; i.e., radius R of wear part 10 is greater than or equal to height H of wear part 10. For example, it can be provided that radius R of wear part 10 is greater than or equal to 1.5 times the height H of wear part 10, or even that radius R of wear part 10 is greater than or equal to two times the height H of wear part 10. Radius R of wear part 10 is not smaller than 0.75 mm and/or is not larger than 2 mm. Preferably, radius R of wear part 10 is not smaller than 1 mm and/or is not larger than 1.5 mm. Height H of wear part 10 is not smaller than 0.4 mm and/or is not larger than 1 mm. Preferably, height H of wear part 10 is not smaller than 0.6 mm and/or is not larger than 0.8 mm. In this exemplary embodiment, for example radius R of wear part 10 is 1.2 mm and height H of wear part 10 is 0.6 mm.

Wear part 10 is made of a noble metal or of a noble metal alloy, such as iridium, platinum, rhodium, ruthenium, and/or rhenium, or of alloys with at least one of these noble metals.

In this exemplary embodiment, side 14 of wear part 10, facing electrode base body 8, stands in direct contact with electrode base body 8. Wear part 10 is connected to electrode base body 8 with a material bond by welding, and in this way regions 12, 18 are formed in wear body 10 and in electrode base body 8 that are fused during the bonding process.

In addition, there is another region in the contact region between electrode base body 8 and wear part 10 in which the material of electrode base body 8 and the material of wear part 10 become alloyed with one another. This alloy region can be smaller than or equal to the sum of the fused regions 18, 12 in electrode base body 8 and in wear part 10. While the boundaries between the alloy region and the fused regions 18, 12 can be fluid, as a rule it is possible to clearly recognize, in section, the boundaries between fused region 12 and non-fused region 11 in wear part 10 or in electrode base body 8. As shown in FIG. 2, wear part 10 can be subdivided into first regions 11 that were not fused during the bonding process and second regions 12 that were fused during the bonding process.

In section, the transitions between non-fused regions 11 of wear part 10 and fused regions 12 of wear part 10 can be seen clearly. The transition on jacket surface 15 between first region 11 of wear part 10 and second region 12 of wear part 10 is designated point A. The transition between first region 11 of wear part 10 and second region 12 of wear part 10, situated closest to longitudinal axis x-x, is designated point C. The distance AC has an angle $\alpha$ to longitudinal axis x-x, or to a line x'-x' that is parallel to longitudinal axis x-x and that goes through point C. In order to determine the distance AC, typically points A and C are regarded in the same second region 12 of wear part 10. Angle $\alpha$ is greater than or equal to 45°. Preferably, angle $\alpha$ is even greater than or equal to 60°.

Preferably, end face 13 of wear part 10 does not have a second region 12 of wear part 10; that is, end face 13 of wear part 10 is completely non-fused, and belongs to first region 11 of wear part 10. Ideally, a distance from point A to end face 13 of wear part 10 is not smaller than 50% of height H of wear part 10. In addition, the distance is not greater than 90% of height H of wear part 10, so that a sufficient quantity of material of wear part 10 has been fused for a solid material bond.

A shortest distance from jacket surface 15 of wear part 10 to point C is not smaller than 50% of radius R of wear part 10, or end surface 13, and/or is not larger than 100% of radius R of wear part 10. This shortest stretch corresponds to a depth t of second region 12 of wear part 10 along a direction radial to longitudinal axis x-x. Due to the fact that it is provided that second region 12 of wear part 10 has a depth t of at least half the radius R of wear part 10, it is ensured that enough material of wear part 10 has been fused to form a solid material bond of wear part 10 with electrode base body 8.

Table 1 shows, for the examples of three cases, R=H, R=1.5 H, and R=2H, the resulting angle $\alpha$ for the threshold values of the boundary conditions. The boundary conditions result from the minimum and maximum height b and from the minimum and maximum depth t of second region 12 in the wear part. Height b of second region 12 of wear part 10 is measured along jacket surface 15. Height b of second region 12 of wear part 10 should correspond to at least 10% and to a maximum of 50% of height H of wear part 10. Depth t of second region 12 of wear part 10 corresponds to the distance of point C from jacket surface 15 in a plane perpendicular to longitudinal axis x-x. Depth t of second region 12 of wear part 10 should be at least 50% and at most 100% of radius R of wear part 10. For the cases stated above, there thus result in each case 4 possible combinations, given the boundary conditions for each of which there results an angle $\alpha$.

TABLE 1

| R/H | b | t | $\alpha$ [°] |
|---|---|---|---|
| 1 | 10% H | 50% R | 78.5 |
| 1 | 10% H | 100% R | 84 |
| 1 | 50% H | 50% R | 45 |
| 1 | 50% H | 100% R | 63 |
| 1.5 | 10% H | 50% R | 82.5 |
| 1.5 | 10% H | 100% R | 86 |
| 1.5 | 50% H | 50% R | 56.5 |

TABLE 1-continued

| R/H | b | t | α [°] |
|---|---|---|---|
| 1.5 | 50% H | 100% R | 71.5 |
| 2 | 10% H | 50% R | 64 |
| 2 | 10% H | 100% R | 87 |
| 2 | 50% H | 50% R | 63 |
| 2 | 50% H | 100% R | 76 |

In the examples stated above, for the angle α there result values in the range of from 45° to 84°. Here, small angles for α (45°-62°) result in particular when second regions 12 of wear part 10 correspond to a large height b, such as 50% of height H of wear part 10, and at the same time have a small depth t, i.e. only 50% of radius R of wear part 10. For the cases having small height b (10% H) and small depth t (50% R) of second region 12 of wear part 10, or having large height b (50% H) and large depth t (100% R) of second region 12 of wear part 10, the values for angle α are in the range of from 63°-83°. For the boundary cases having small height b and large depth t of second region 12 of wear part 10, corresponding to a narrow and deep bond seam, the values for angle α are in the range of from 84°-87°. From this it can be inferred that, in a particularly preferred specific embodiment of the present invention, angle α is preferably greater than or equal to 80°.

The material bonding of wear part 10 with electrode base body 8 preferably takes place via a welding method such as laser beam welding or electrode beam welding. In the case of laser beam welding, a pulsed laser beam or a continuous laser beam, i.e. continuous-wave (CW) laser, can be used. In the production of the laser radiation, solid-state lasers, disk lasers, diode lasers, and/or fiber lasers can be used.

Weld beam 20 is directed onto the contact region between wear part 10 and electrode base body 8 at an angle β relative to longitudinal axis x-x, as is schematically shown in FIG. 2. In order to achieve a depth t that is as large as possible, and at the same time a height b that is as small as possible, of second region 12 in wear part 10, weld beam 20 is radiated into the contact region at an angle β not smaller than 75°, preferably not smaller than 81°.

The focus point for weld beam 20 is for example inside the contact region, i.e., preferably on the stretch between point C and jacket surface 15. Advantageously, weld beam 20 has at the focus point a diameter of not greater than 50 μm. In this way, a weld seam, or bond seam, is produced that is as deep as possible and at the same time not too high. The shape of the weld seam correlates with the geometry of fused regions 12, 18 in wear part 10 and in electrode base body 8.

Generally, when the ratio of radius R to height H of wear part 10 increases, the angle of incidence β of weld beam 20 must also increase in order to produce an adequate depth t of second region 12 of wear part 10 and thus also to produce a reliable solid connection between electrode base body 8 and wear part 10, without requiring fusing that is excessive in height on jacket surface 15.

Preferably, welding takes place at least along a part of the circumference of wear part 10. For example, it can be provided that a continuous weld seam is produced along the entire circumference of wear part 10. Alternatively, the weld seam can also be divided into a plurality of subsegments, the subsegments on jacket surface 15 of wear part 10 being at a distance from one another and/or overlapping within the contact region and/or within wear body 10 and/or within electrode base body 8. Preferably, the non-fused regions of 11 in wear part 10 are contiguous, so that preferably there is only one first region 11 in wear part 10.

FIG. 3 shows two possible realizations for producing an electrode according to the present invention as center electrode 5. In the first realization, FIG. 3*a*, weld beam source 21 is stationary and electrode 5 with electrode base body 8 and wear part 10 rotates about an axis, in this example longitudinal axis x-x of wear part 10. In the second realization, FIG. 3*b*, weld beam source 21 rotates about electrode 5.

Figure 4:
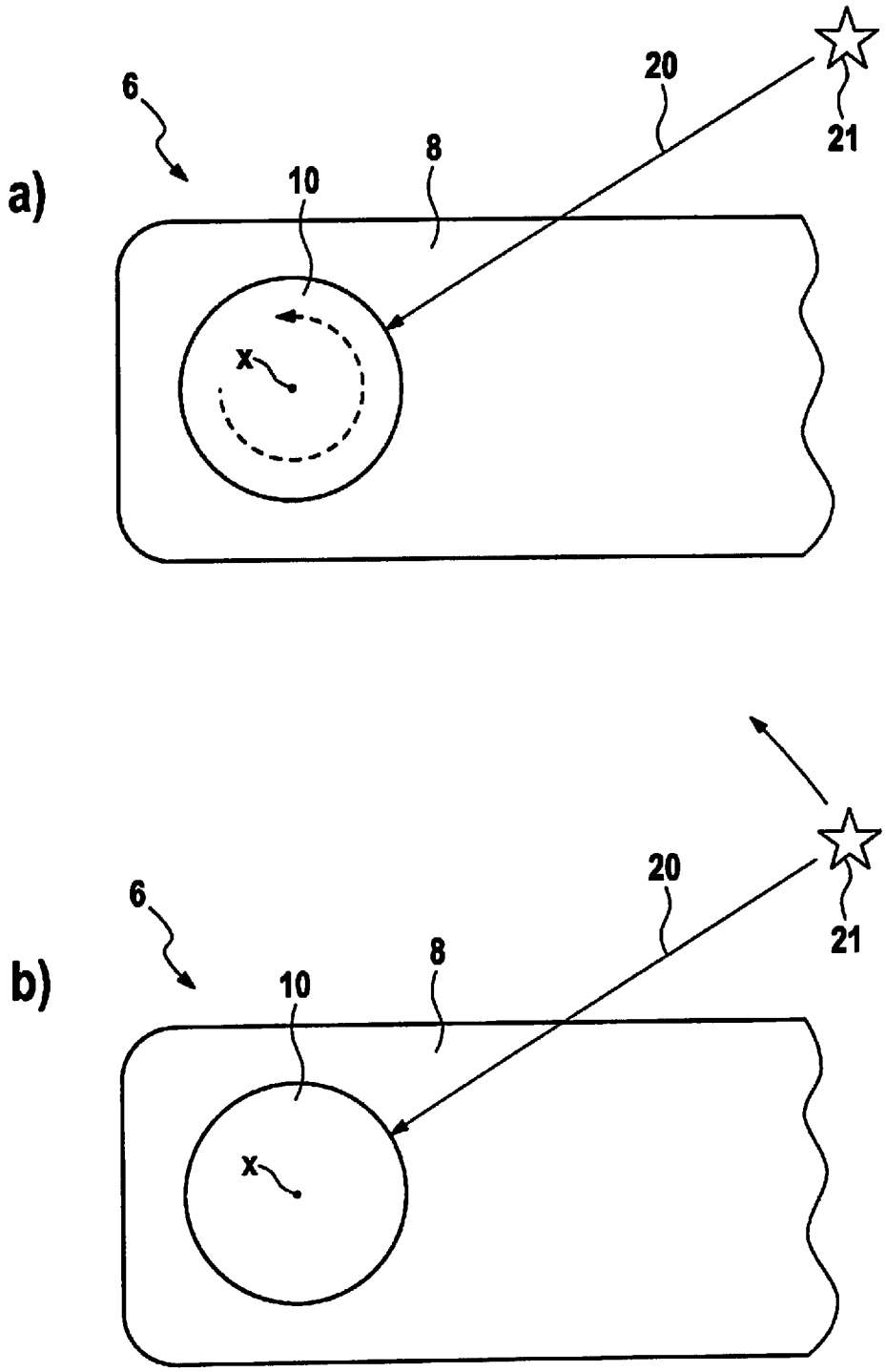
FIG. 4 shows an example of the production of a ground electrode according to the present invention.

FIG. 4 shows two possible realizations for producing an electrode according to the present invention as ground electrode 6. In the first realization, FIG. 4*a*, weld beam source 21 is stationary and electrode 6 with electrode base body 8 and wear part 10 rotates about an axis, in this example longitudinal axis x-x of wear part 10. In the second realization, FIG. 4*b*, weld beam source 21 rotates about electrode 6.

In addition, it can be provided that the power of weld beam 21 is varied during the welding of ground electrode 6. In this way, power losses that occur during welding, when for example during the rotation of electric 6 or of weld source 21 a leg 16 of a ground electrode 6 moves into weld beam 20 and thus blocks a part of weld beam 20, can be compensated.

Figure 5:
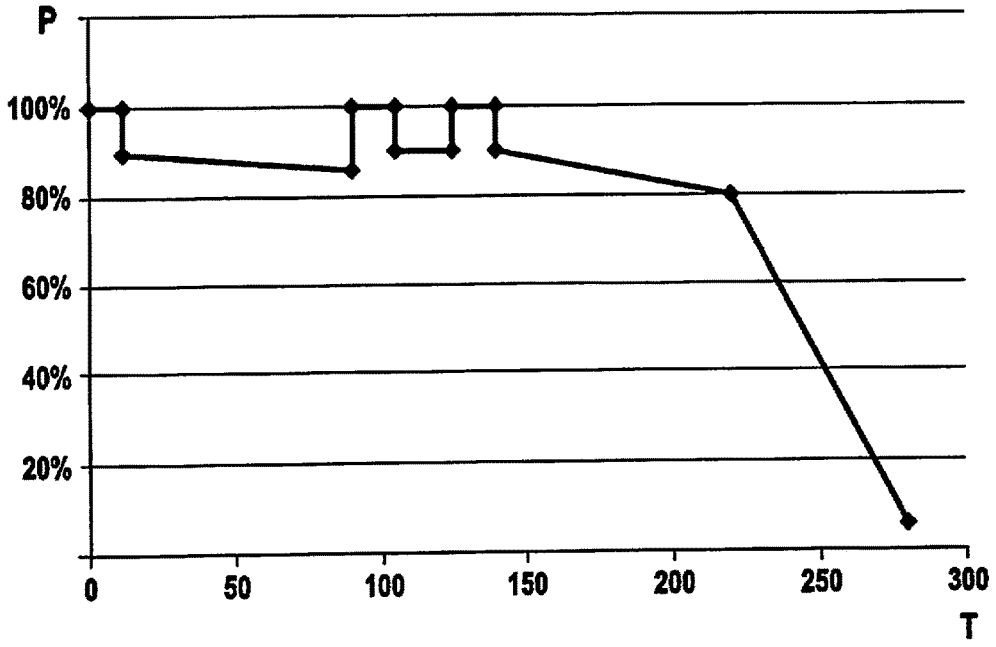
FIG. 5 shows an example of the time curve of the weld beam power.

FIG. 5 shows an example of a time curve T of power P of weld beam 20 during the welding of a bow ground electrode 6. In a first operating phase, power P is held at a constant value. In this phase, the regions 12, 18 that are to be fused in wear part 10 and in electrode base body 8 are heated, and in this way the melt baths required for the deep welding are produced in electrode base body 8 and in wear part 10. In the second operating phase, power P is reduced to 80% to 90% of the initial power. This reduced power P is adequate to ensure that the melt baths, together with weld beam 20, move along the circumference of wear part 10 according to the rotational speed of electrode 6 or of weld beam source 21, in this way producing the bond seam. In this exemplary embodiment, the second operating phase is interrupted twice by a third operating phase in which power P is again increased to the initial value in order to compensate the shadowing effects produced by legs 16 of ground electrode 6, situated at times in weld beam 20, for power level P deposited into electrode 6. After at least one full rotation, in a fourth operating phase power P is reduced to 0% and the welding process is terminated.

Advantageously, the initial position of the welding and/or the direction of rotation during the welding is selected such that the components of spark plug 1 that cause the shadowing effects move into weld beam 20 as late as possible within the course of a rotation.

What is claimed is:

1. An electrode for a spark plug, comprising:

an electrode base body; and a cylindrical wear part, the wear part having a longitudinal axis that extends from a first end face of the wear part, facing the electrode base body, to a second end face situated opposite the first end face, and the wear part having at least one first region and at least one second region, the wear part not being fused in the at least one first region and the wear part being fused in the at least one second region, at least a portion of the at least one second region being free from contact with the electrode base body at a side of the wear part extending from the first end face toward the second end face, and, in a sectional plane of the longitudinal axis, a first transition between the at least one first region and the at least one second region on a jacket surface of the wear part being designated as point A, and in the sectional plane, a second transition between the at least one first region and the at least one second region, situated closest to the longitudinal axis in the sectional plane, being designated as point C;

wherein the distance AC has an angle $\alpha$ to the longitudinal axis, the angle $\alpha$ extending from the longitudinal axis back toward the first end face, and $\alpha$ is greater than or equal to 45° and less than 90°;

wherein the cylindrical wear part has a height (H) and a radius (R), the height (H) in the first region being measured along the longitudinal axis, and the radius (R), in the case of polygonal end surfaces, being a perimeter radius or, in the case of round end surfaces, being a circular radius, and $R \geq H$.

2. The electrode as recited in claim 1, wherein $R \geq 2H$.

3. The electrode as recited in claim 1, wherein a shortest distance from the jacket surface of the wear part to point C is at least one of: (i) not smaller than 50% of the radius (R), and (ii) not larger than 100% of the radius (R).

4. The electrode as recited in claim 1, wherein the radius (R) is at least one of: (i) not smaller than 0.75 mm, and (ii) not larger than 2 mm.

5. The electrode as recited in claim 1, wherein the height (H) is at least one of: (i) not smaller than 0.4 mm, and (ii) not larger than 1 mm.

* * * * *